US007596916B1

(12) United States Patent
Anderson

(10) Patent No.: US 7,596,916 B1
(45) Date of Patent: Oct. 6, 2009

(54) MULTI BEVELED INTERLOCKING CORNER NOTCH AND ASSOCIATED ANTI SETTLING SYSTEM

(76) Inventor: Richard Thomas Anderson, 6615 Boydton Plank Rd., Petersburg, VA (US) 23803

( * ) Notice: Subject to any disclaimer, the term of this patent is extended or adjusted under 35 U.S.C. 154(b) by 548 days.

(21) Appl. No.: 11/088,924

(22) Filed: Mar. 25, 2005

Related U.S. Application Data

(60) Provisional application No. 60/555,973, filed on Mar. 25, 2004.

(51) Int. Cl.
*E04B 1/10* (2006.01)

(52) U.S. Cl. ..... 52/233; 52/286

(58) Field of Classification Search ..... 52/233, 52/286; 446/106; 403/339, 340; 144/344, 144/345, 354
See application file for complete search history.

(56) References Cited

U.S. PATENT DOCUMENTS

| | | | | | |
|---|---|---|---|---|---|
| 910,510 | A * | 1/1909 | Davis | 301/132 |
| 2,059,598 | A * | 11/1936 | Paulson | 446/106 |
| 2,525,659 | A * | 10/1950 | Edson et. al. | 52/233 |
| 2,588,814 | A * | 3/1952 | Erland et al. | 403/346 |
| 3,189,950 | A * | 6/1965 | Johnson | 52/233 |
| 3,534,518 | A * | 10/1970 | Zagray | 52/258 |
| 3,552,079 | A * | 1/1971 | Mortenson | 52/592.6 |
| 4,287,694 | A * | 9/1981 | Cornell | 52/233 |
| 4,330,973 | A * | 5/1982 | Marklund et al. | 52/233 |
| 4,429,500 | A * | 2/1984 | Farmont | 52/233 |
| 4,901,489 | A * | 2/1990 | Garber | 52/233 |
| 5,103,610 | A * | 4/1992 | Walters | 52/233 |
| 5,638,649 | A * | 6/1997 | Hovland | 52/233 |
| 5,846,114 | A * | 12/1998 | Frandsen, II | 446/106 |
| 6,023,895 | A * | 2/2000 | Anderson | 52/233 |
| 6,146,232 | A * | 11/2000 | Robbins | 446/106 |
| 6,189,271 | B1 * | 2/2001 | Christensen | 52/233 |
| 6,412,241 | B1 * | 7/2002 | Chambers | 52/233 |
| 6,564,526 | B2 * | 5/2003 | Chambers | 52/747.1 |
| 6,923,705 | B2 * | 8/2005 | DeSalvo et al. | 446/106 |
| 2002/0121055 | A1 * | 9/2002 | Englehart | 52/233 |
| 2004/0134142 | A1 * | 7/2004 | Stutts | 52/233 |
| 2004/0182023 | A1 * | 9/2004 | Chambers | 52/233 |
| 2004/0187411 | A1 * | 9/2004 | Clegg | 52/233 |
| 2006/0168904 | A1 * | 8/2006 | Muszynski | 52/233 |

* cited by examiner

*Primary Examiner*—Robert J Canfield
*Assistant Examiner*—Brent W Herring

(57) ABSTRACT

The present invention discloses a log cabin construction using naturally tapered logs with multi-beveled interlocking notches located at the end of each log. The interlocking notches serve to form a tight locking connection at the cornering of the structure where the logs overlap one another. The interlocking notches are composed substantially of heartwood, which serves to reduce settlement and maintain a tight connection over time. The measurements for the interlocking notches are a function of the dimensions of the logs used. The log cabin construction further employs anti-settling blocks which are disposed between the logs of the structure. In the preferred embodiment, the anti-settling blocks are positioned in aligned recesses which are present in the logs that compose the structure. Accordingly, the presence of the interlocking-notch cornering system and the anti-settling blocks combine to minimize the negative effects of settling on the structure while providing an aesthetically pleasing appearance.

8 Claims, 17 Drawing Sheets

$$SD^2 - W^2 = SH^2$$ FIG. 5

$$LD^2 - W^2 = LH^2$$ FIG. 6

$$.5 ( LH - SH ) = F$$ FIG. 7

$$.25 ( SH - F ) = SM$$ FIG. 8

$$SM + F = LG$$ FIG. 9

$$SM + LG = BH$$ FIG. 10

$$BH + 2SM = SH$$ FIG. 11

$$BH + 2LG = LH$$ FIG. 12

$$SD^2 - F^2 = SW^2$$ FIG. 13

$$LD^2 - F^2 = LW^2$$ FIG. 14

$$.5LH + .5F = PLW$$ FIG. 15

$$.5SH - .25F = PSW$$ FIG. 16

$$.5\,(LW - W) = LX$$ FIG. 17

$$.5\,(SW - W) = SX$$ FIG. 18

MULTI BEVELED INTERLOCKING CORNER NOTCH AND ASSOCIATED ANTI SETTLING SYSTEM

CROSS-REFERENCE TO RELATED APPLICATIONS

This application claims priority from U.S. Provisional Application 60/555,973 filed Mar. 25, 2004.

BACKGROUND OF THE INVENTION

It is not known when the first log building structure was constructed, but many examples show that they have been around for several centuries. Traditionally, log homes are constructed by laying the logs horizontally on top of each other to form walls. The logs are then notched to interlock with the logs in the perpendicular walls to provide corners with substantial stability and strength.

Today the log home industry is categorized into two types of construction: manufactured or handcrafted. Log handcrafters use hand tools and handheld power tools to shape each individual log to mate with the logs they contact. Most handcrafted logs still retain each log's natural taper and shape on the visible portions of the log which is usually left round. These logs generally use some variation of what is known as a saddle notch. This is where a half round keyway is carved into the bottom of the log to tightly fit over the top of the perpendicular logs that it rests on at each corner, or intersection, of the building. The problem with handcrafted log homes is settling due to the natural shrinkage of logs and the high costs of the labor intensive process to build these log homes.

Manufacturers use power saws and planers to shape the interchangeable logs into uniform shape and size. Much of the time a large portion of the outer sapwood is removed, leaving a high proportion of the heartwood. Since heartwood is denser, having a lower percentage of water, there is a lower amount of shrinkage than with the sapwood of a tree. The problem with manufactured log homes is that many people believe that they lack the natural charm and character of their handcrafted counter parts.

This invention provides a way to have a look very similar to handcrafted log homes but at a more economical price with less shrinkage of the walls.

BRIEF SUMMARY OF THE INVENTION

This multi-beveled interlocking corner notch can be used with either hand peeled, naturally tapered logs or logs that have been machine-profiled. The notch uses a center block that is centered basically on the long axis of the log. The height of this center block is mathematically determined based on the overall height of the large and small ends of the log. This enables the notch to be used with almost any sized log or piece of timber. The notch consists of twelve to eighteen flat surfaces, depending on the width of the top and bottom surfaces running the length of the log.

Having the center block composed mainly of heartwood will result in a type of notch that will have much less shrinkage than handcrafted logs that use saddle notches that remove sections of the lower heartwood and retain all the upper sapwood. Since shrinkage in the corner sections of this invention has been greatly reduced, measures are also made to keep the rest of the wall from shrinking at a faster rate than the corners. This is accomplished by boring holes through the sapwood to solid heartwood around the points where the thru-bolts penetrate the logs, and then filling the holes with wooden blocks made out of similar heartwood.

BRIEF DESCRIPTION OF THE SEVERAL VIEWS OF THE DRAWINGS

FIG. 3AA is the sectional view of the notch on the large end of the log.

FIG. 3AB is the top view of the notch on the large end of the log.

FIG. 3AC is the bottom view of the notch on the large end of the log.

FIG. 3BA is a sectional view of the notch on the small end of the log.

FIG. 3BB is the top view of the notch on the small end of the log.

FIG. 3BC is the bottom view of the notch on the small end of the log.

FIG. 3CA is the sectional view of the anti-settling thru-bolt and filler block.

FIG. 3DA is the sectional view of the anti-settling thru-bolt and block with an attached beam for an interior partition.

FIG. 4AA is a sectional view of the notch on the large end of the half log.

FIG. 4BA is the sectional view of the notch on the small end of the half log.

FIG. 5 is the mathematical formula to determine distance SH.

FIG. 6 is the mathematical formula to determine distance LH.

FIG. 7 is the mathematical formula to determine distance F.

FIG. 8 is the mathematical formula to determine distance SM.

FIG. 9 is the mathematical formula to determine distance LG.

FIG. 10 is the mathematical formula to determine distance BH.

FIG. 11 is the mathematical formula to determine distance SH.

FIG. 12 is the mathematical formula to determine distance LH.

FIG. 13 is the mathematical formula to determine distance SW.

FIG. 14 is the mathematical formula to determine distance LW.

FIG. 15 is the mathematical formula to determine distance PLW.

FIG. 16 is the mathematical formula to determine distance PSW.

FIG. 17 is the mathematical formula to determine distance LX.

FIG. 18 is the mathematical formula to determine distance SX.

DETAILED DESCRIPTION OF THE INVENTION

This invention provides a novel interlocking corner notch and anti-settling blocks that can be used in the construction of log buildings.

The following example uses logs that retain their natural taper and rounded sides with top and bottom surfaces that have been milled flat for added stability of each log.

Because these logs use flat top and bottom surfaces, each notch contains eighteen flat surfaces, opposed to the eight flat surfaces that would be used with logs that are completely rounded. The ten additional surfaces just become the points of contact for the remaining eight surfaces.

Figure 1:
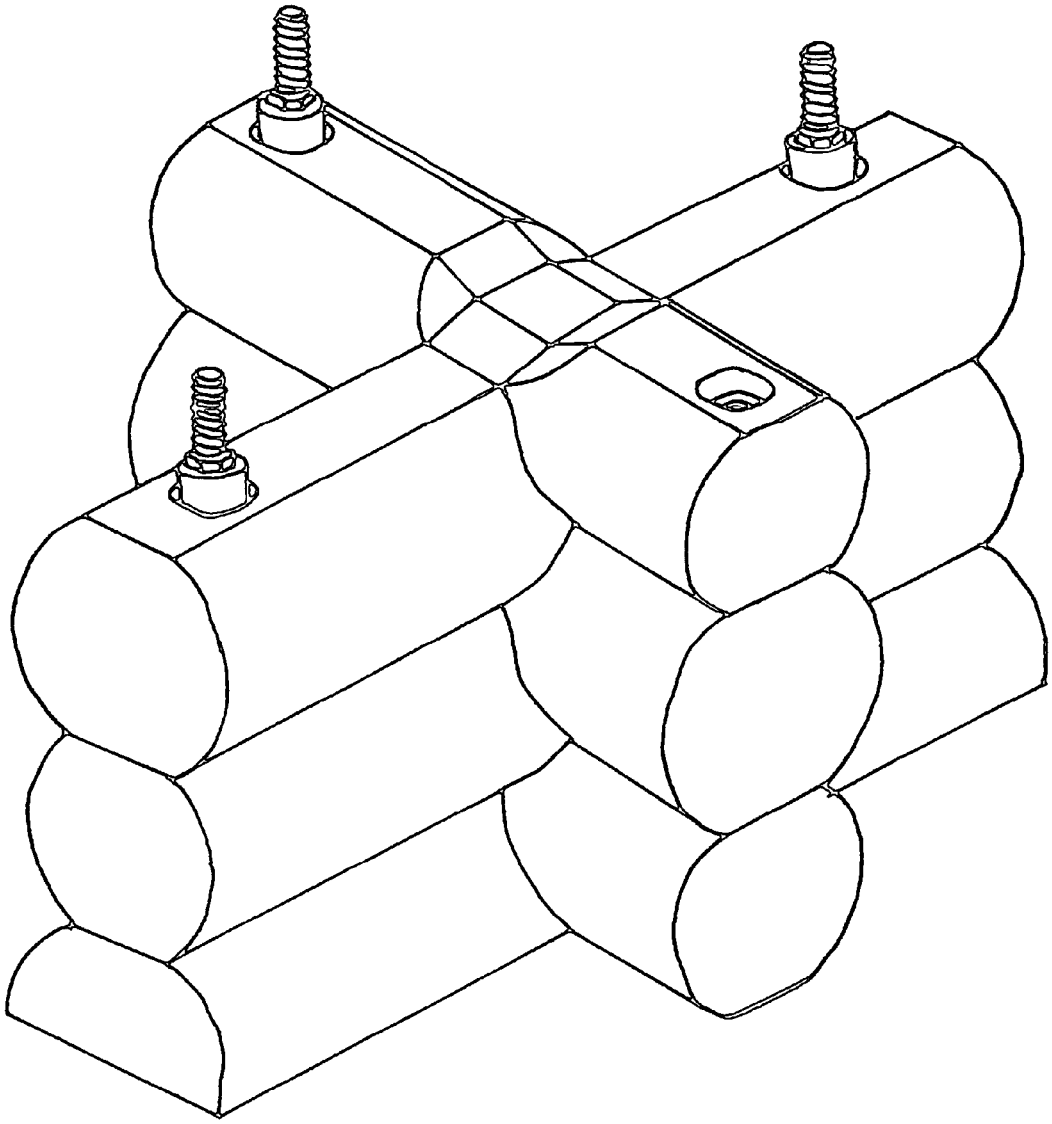
FIG. 1 is a three-dimensional view of a typical corner section using the invention with naturally tapering logs.

Once assembled, the logs in a wall built with this style of notch closely handcrafted logs that use saddle notches, as seen in FIG. 1.

Figure 3:
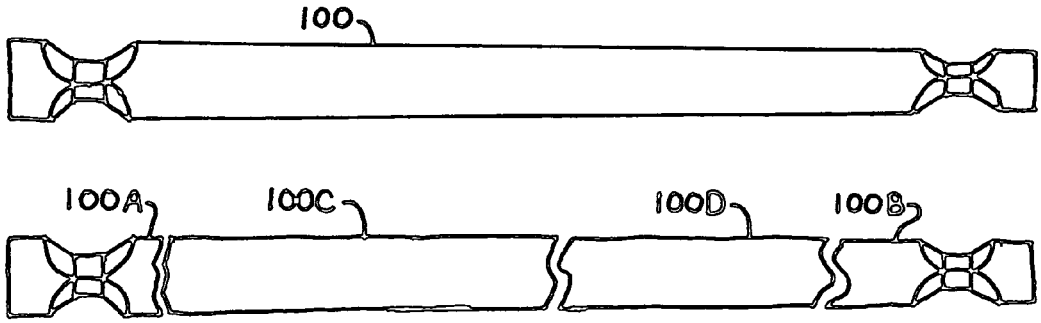
FIG. 3 is the side view of the log and a view of the same log divided into four parts for detailed views.

The logs used in this invention consist of a log that uses a notch on each end, with the top half of the notch on the large end of the log and the bottom half of the notch on the small end of the log milled to mate with the large end of other logs 100. Likewise, the bottom half of the notch on the large end, and the top half of the notch on the small end, mate with the other small ends of logs 100, as shown in FIG. 3.

Figure 4:
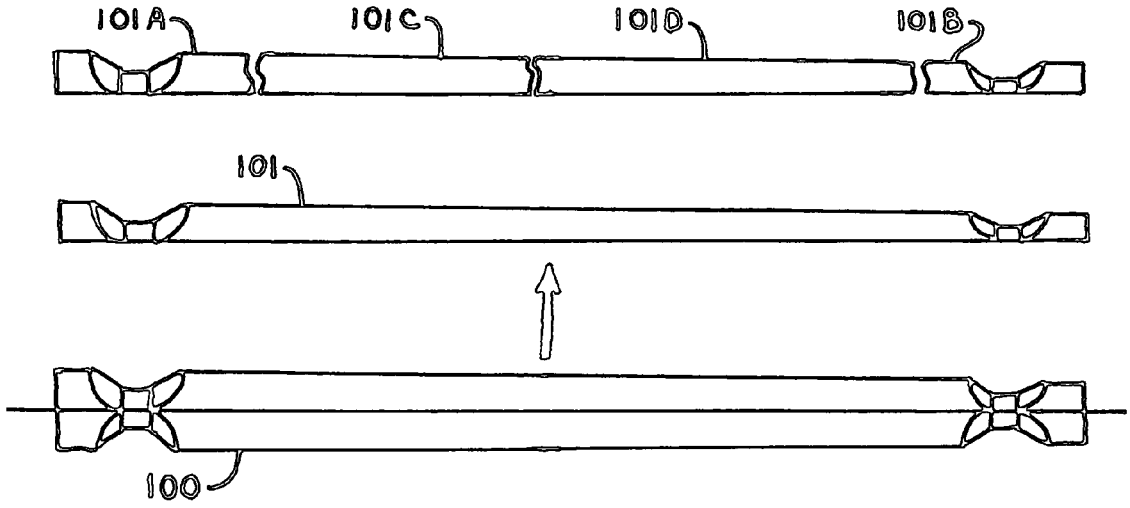
FIG. 4 is the side view of the half log sectioned off of a full log and a second view of the same half log divided into four parts for detailed views.

As seen in FIG. 4, the half log 101 is simply a log 100 dissected on a plane that runs through the vertical meeting points of the upper and lower halves of the notches on both end of the log with everything above this plane being half log 101.

Figure 2:
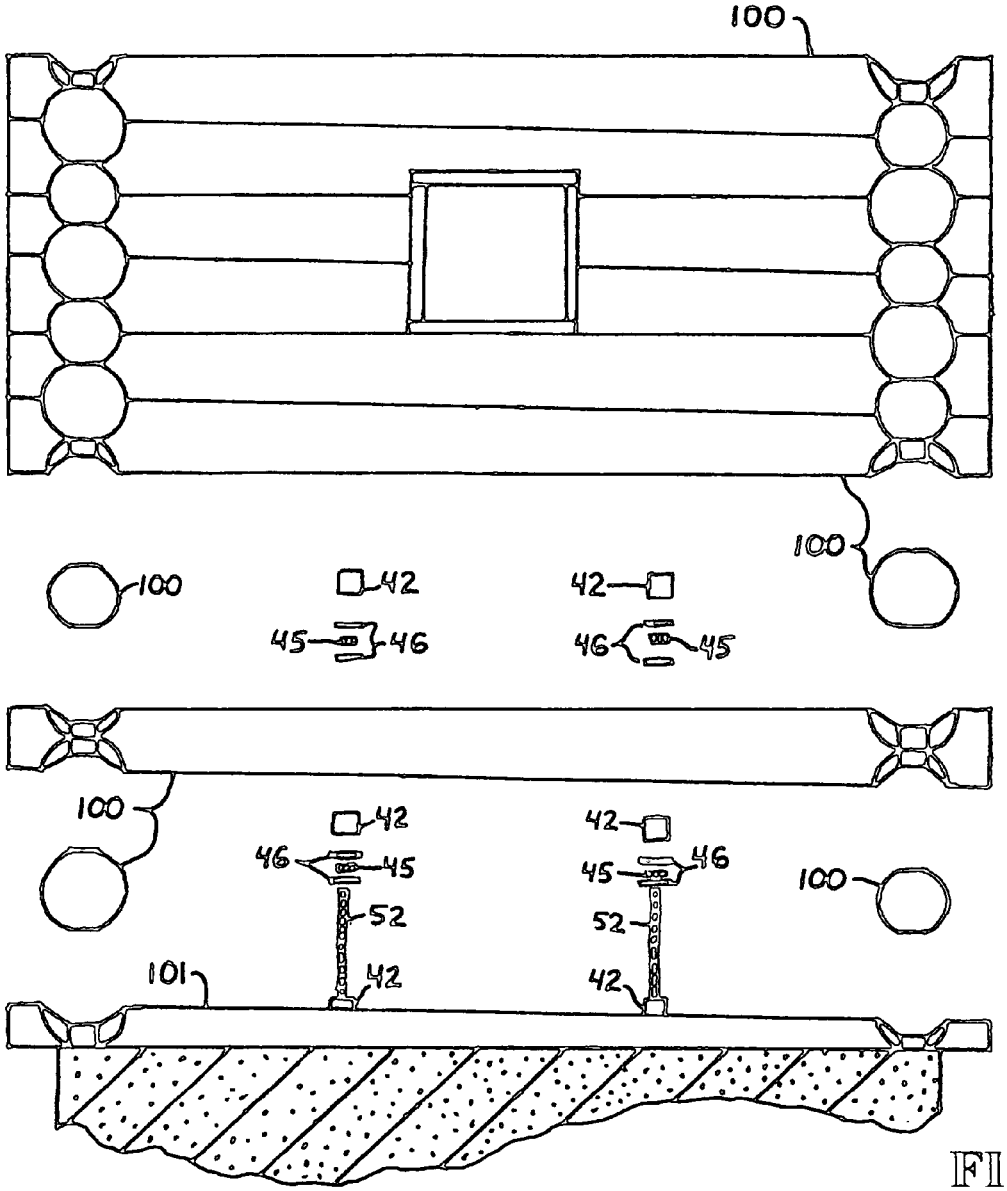
FIG. 2 is an exploded front elevation view of a typical structure.

FIG. 2 is a partially-exploded side elevation view of a typical log cabin. First, a foundation of choice is constructed in advance with threaded rods 52 attached or imbedded as desired or as may be required by local codes or the building's architect. Half logs 101 are then placed over threaded rods 52 on two parallel wall positions with the large ends of the half logs on opposing corners. On the two wall positions perpendicular to the first half logs, spacer blocks 42 are placed over threaded rods 52 and placed directly on the foundation sills. A log 100 is then placed over threaded rods 52 on each perpendicular wall position with the logs 100 being in position upside down from the position shown in FIG. 3, and the large ends of log 100 being placed directly on top of the large ends of logs 101. In these positions, the large half of the notches on the large end of logs 100 mate with the matching large half of half log 101, and the small ends also mate together. Washers 46 and retaining nuts 45 are then placed on each threaded rod 52 and snugly tightened to hold the logs in this first course securely in place.

The next course of logs is started by placing spacer blocks 42 onto each threaded rod 52 with the spacer blocks resting in their appropriate recessed holes on the top of the logs on the course below. Logs 100 are then placed onto the threaded rods 52, on the two parallel first walls, in the upright position with the large ends of these logs resting on the small end of the logs, on the same wall, directly below. Logs 100 are then placed, in the upside down position, over the threaded rods 52 on the two perpendicular walls with the large ends of the logs resting on the small ends of the logs directly below on the same wall. Washer 46 and retaining nut 45 are then placed on each threaded rod 52 and tightened.

This process is repeated as many times as necessary until the desired height is attained and the roof can then be assembled and openings for doors and windows cut out of the wall.

The dimensions of the logs 100 are determined by a series of mathematical formulas. To start, a log is chosen from a group of similar logs that are debarked, generally straight, and of approximately the same length and diameter. The desired width of the flat top and bottom surfaces is chosen, whether chosen for stability or appearance, and becomes distance W.

FIG. 5 is the mathematical formula that shows the overall finished height of the log at the notch on the small end of the log. The log diameter at the small notch, distance SD, is squared. Subtracted from this is distance W squared; the result is distance SH squared.

FIG. 6 is the mathematical formula to find the overall finished height of the log at the notch on the large end of the log. The log diameter at the large notch, distance LD squared, minus distance W squared, equals distance LH.

FIG. 7 shows that the height of the end of the log LH, minus the height of the small end SH, equals distance F.

FIG. 8 shows the mathematical formula to find distance SM. The height of the log at the small end notch, distance SH, minus distance F, is then divided by four to give us distance SM.

FIG. 9 shows how to calculate distance LG. Distance LG is determined by adding distance SM and distance F.

FIG. 10 shows the height of the center block. The height of the center block, BH, is equal to the distance SM added to distance LG FIG. 11 is a way to cross-reference distances SH, BH, and SM. Distance SM multiplied by two is added to distance BH, equaling distance SH.

FIG. 12 cross-references distances LH, LG, and SM. Distance LG multiplied by three and added to distance SM equals distance LH.

FIG. 13 is used to determine the overall width of the notch on the small end of the log, designated as distance SW. The diameter of the small end of the log SD squared, minus distance F squared, equals distance SW squared.

FIG. 14 shows the mathematical formula to determine the overall width of the notch on the large end of the log. The diameter of the log at the notch on the large end of the log LD squared minus distance F squared equals distance LW.

FIG. 15 shows the mathematical formula to determine the distance that the plane on which the widest part of the notch on the large end of the log LW sits on PLW is from the top surface of the large end of the log. The height of the large end of the log LH plus one half of distance F equals distance PLW.

FIG. 16 can be used to find the distance between the plane on which the widest part of the small end notch SW sits on PSW from the top surface of the small end of the log. One half of the height of the small end of the log SH minus one forth of the distance F equals distance PSW.

FIG. 17 is used to determine distance LX. The overall width of the notch on the large end of the log LW minus distance W is then divided by two. This equals distance LX.

FIG. 18 is used to determine distance SW. The overall width of the notch on the small end of the log SW minus distance W and then divided by two equals distance SX.

Figure 3A:
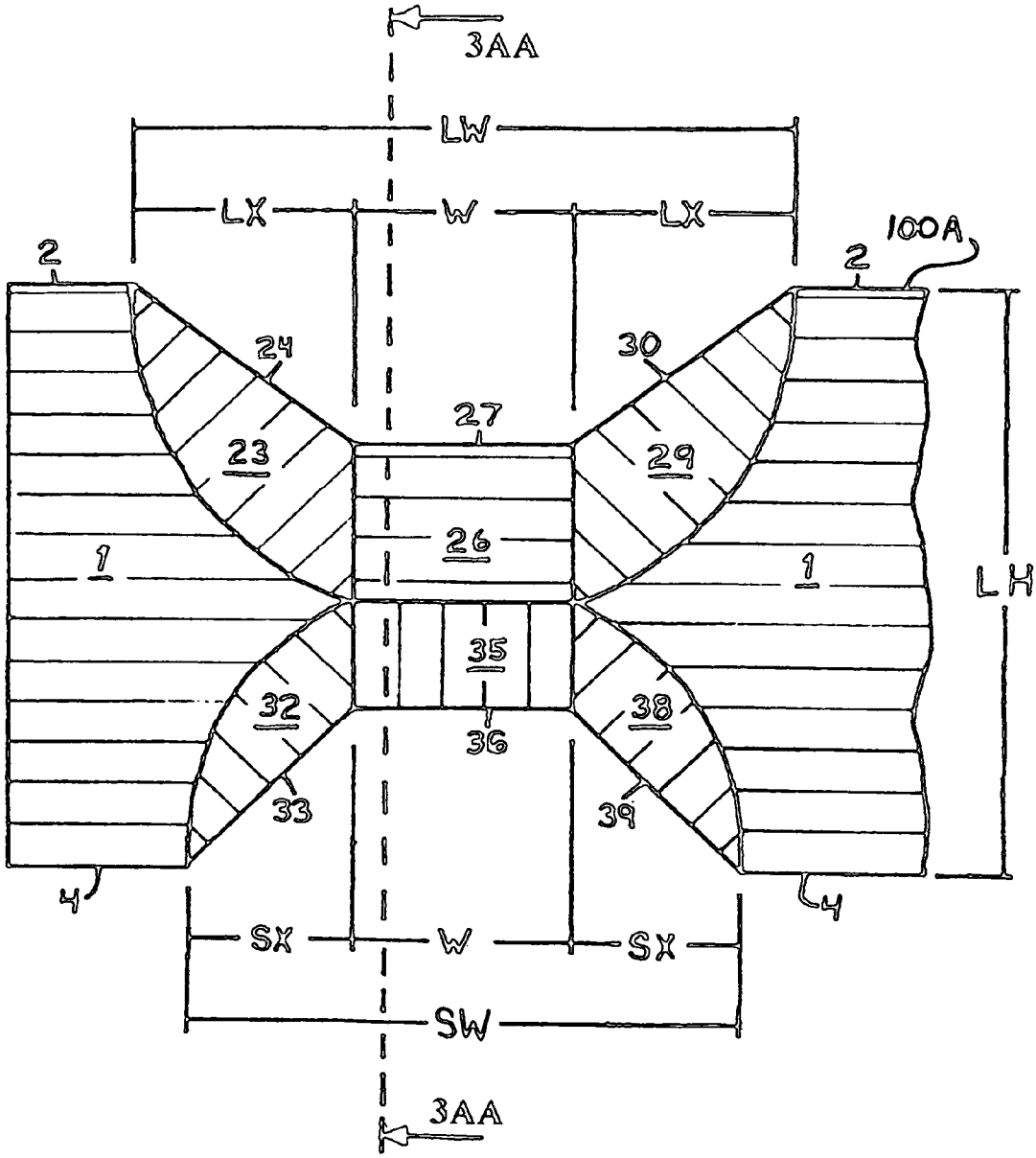
FIG. 3A is a side view of the notch on the large end of the log.
Figure 3A:
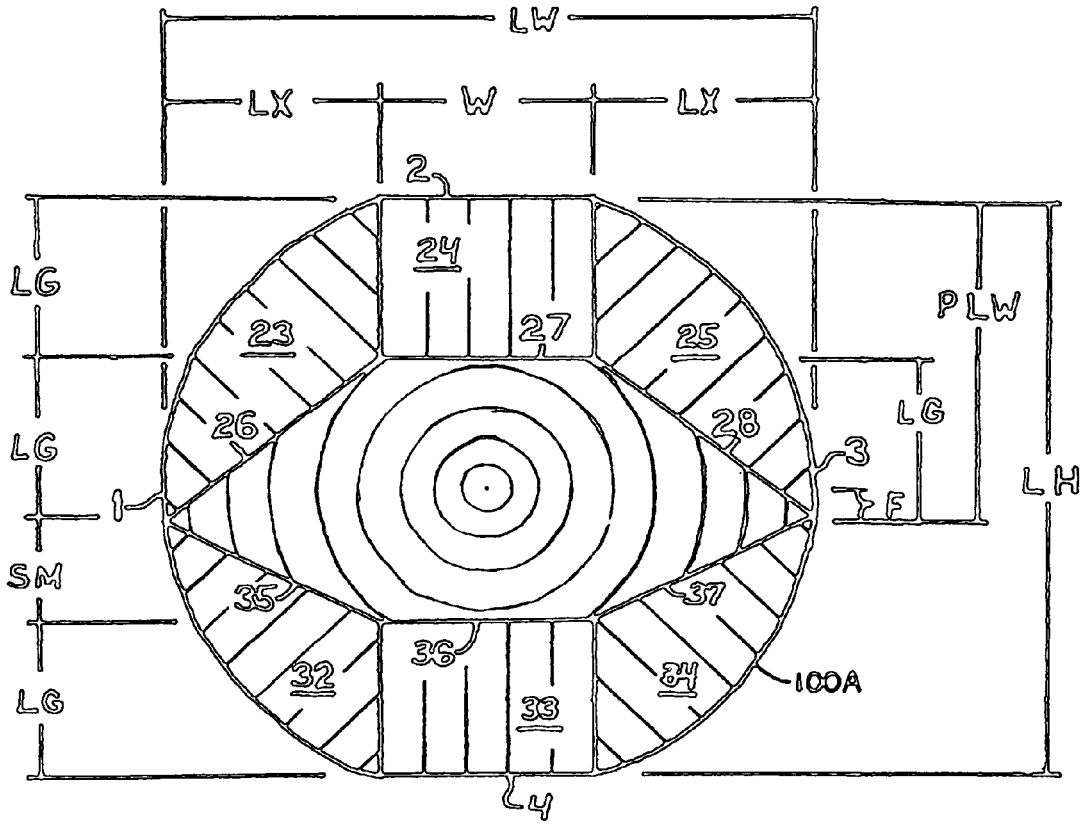
Figure 3A:
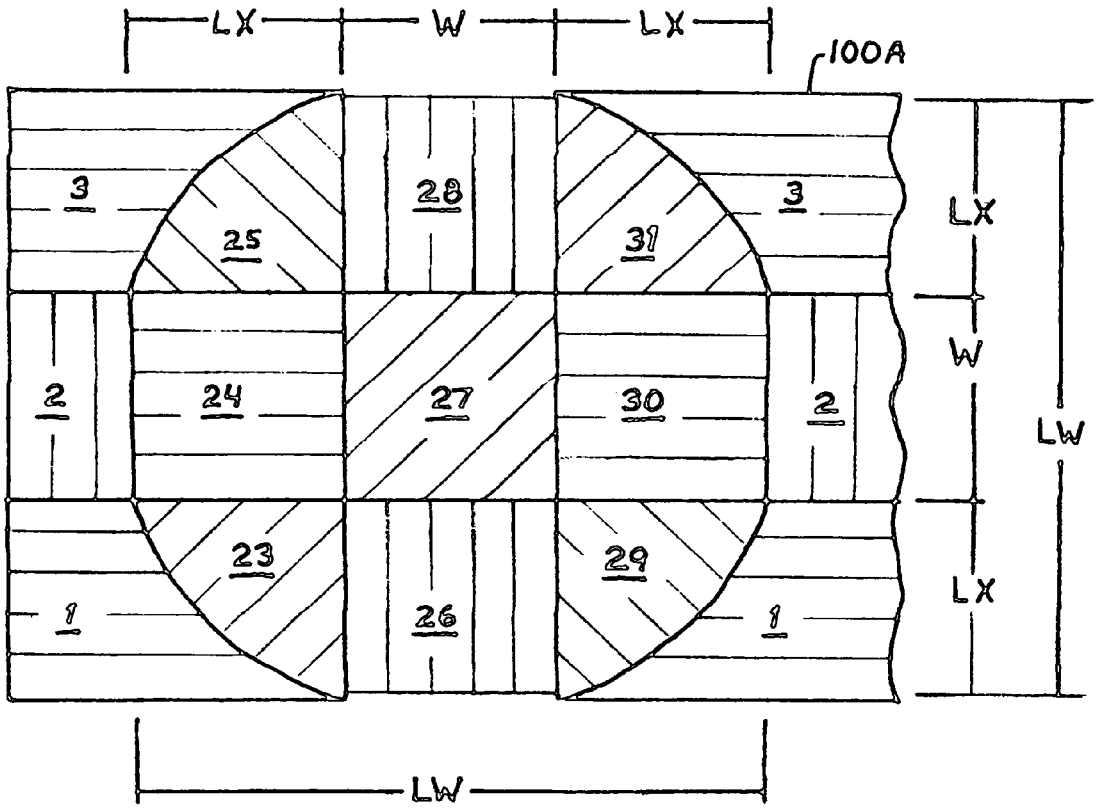
Figure 3A:
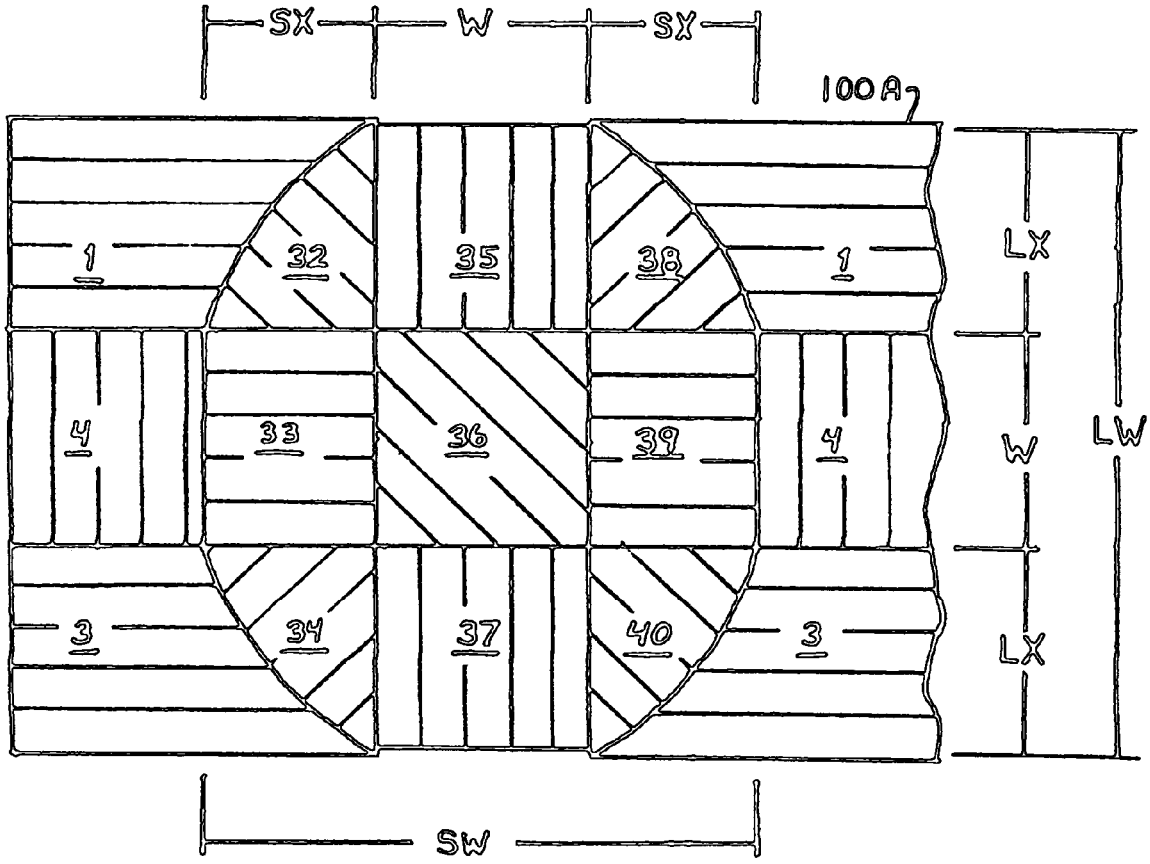

FIG. 3A is the front view of the notch on the large end of the log; surface 1 being the natural round front side of the log, surface 2 the flat top of the log, and surface 4 the flat bottom.

Distance W, as chosen above, is also the same width of the center block, the top surface being 27 and the bottom surface being 36.

Both of these surfaces have no tilt in relation to the radius or the length of the log. Surfaces 24 and 30 have no tilt in relation to the radius of the log and both angle upwards in opposite directions from surface 27 until they each reach surface 2 on the edge of the notch in relation to the length of the log. Surface 26 is level in relation to the length of the log but angles downward towards the front outside of the notch in relation to the radius of the log.

Surface 23, being on a plane with a compound angle, has the same upward tilt from surface 26 as surface 24 does from 27 in relation to the length of the log, and the same downward angle from surface 24, in relation to the radius of the log, as surface 26 down from surface 27.

Surface 29 being on a plane with a compound angle has the same rate of incline from surface 26 in relation to the length of the log as surface 30 from surface 27, and the same downward angle from surface 30 as surface 26 slopes down from surface 27 in relation to the radius of the log.

Distance LX is found in FIG. 17, LW in FIG. 14, and LH in FIG. 12. Surface 35 is level in relation to the length of the log and slopes upward from surface 36 towards the outside of the notch to the point where it meets surface 26 in relation to the radius of the log. Surface 33 has no radius tilt and angles downward from surface 36 to surface 4 in relation to the length of the log.

Surface 32, being on a plane with a compound angle, has the same radial incline up from surface 33 as surface 35 does from surface 36, and the same downward angle from surface 35, in relation to the length of the log, as surface 33 does from surface 36.

Surface 38, being on a plane with a compound angle, has the same radial angle from surface 39 as surface 35 does from surface 36, and the same downward slope from surface 35 as surface 36 does from 39 in relation to the length of the log. Distance SX is determined in FIG. 18, and distance SW is found in FIG. 13.

FIG. 3AA is a sectional view of the notch on the large end of the log; surface 1 being the natural front surface of the log, surface 2 the top, and surface 4 the bottom. The depth of surfaces 2 and 4 each equal distance W, with the overall depth of the notch being distance LW as determined in FIG. 14.

The horizontal distance between where surfaces 23 and 4 meet to where surfaces 23 and 32 meet equals distance LX, as shown in FIG. 17. The vertical height between where surface 24 meets surface 2 and where surface 24 meets 27 is distance LG, as shown in FIG. 9. The vertical distance from where surface 26 meets 27 to where surface 26 meets 35 is also distance LG.

The vertical distance where surface 35 meets 26 to where surface 35 meets 36 equals distance SM, as determined in FIG. 8. The vertical distance from where surface 33 meets 36 to where surface 4 meets surface 33 also equals distance LG. The vertical height from where surface 28 meets surface 37 to the top of distance LH, as explained in FIG. 6, equals distance PLW, as shown in FIG. 15.

Surfaces 26, 27, 28, 35, 36, and 37 all have no tilt in relation to the length of the log.

Surface 23 sits on a plane with compound angles having the same downward angle from surface 24 as surface 26 from 27, in relation to the radius of the log, and the same upward angle from surface 26 as surface 24 does from 27, in relation to the length of the log.

Surface 25 is on a plane with compound angles having the same upward slope from surface 28 as surface 24 does from surface 27 in relation to the length of the log, and the same downward angle from surface 24 as surface 28 from surface 27 in relation to the radius of the log.

Surface 32, being on a plane with compound angles, has the same upward angle from surface 33 as surface 35 does from 36 in relation to the radius of the log, and the same downward angle from surface 35 as surface 33 does from surface 36 in relation to the length of the log.

Surface 34, also being on a plane with a compound angle, has the same downward angle from surface 37 as surface 33 does from surface 36 in relation to the length of the log, and the same upward angle from surface 33 as surface 37 does from surface 36 in relation to the radius of the log.

FIG. 3AB is the top view of the notch on the large end of the log. The width of surfaces 26, 27, 28, and the depth of surfaces 2, 24, 27, and 30, all equal distance W. The horizontal distance of the width of surfaces 23, 24, 25, 29, 30, and 31, as well as the horizontal depth of surfaces 23, 26, 29, 25, 28, and surface 31, each equal distance LX, as found in FIG. 17.

Surface 1 is the naturally round front of the log, surface 3 being the naturally round rear of the log, and surface 2 the flat top surface of the log. Surface 27 is the top surface of the center block having zero tilt in relation to the radius and the length of the log.

Surfaces 24 and 30 angle upward, in opposite directions, from surface 27 to surface 2 on each side of the notch in relation to the length of the logs and have no tilt in relation to the radius of the log.

Surfaces 26 and 28 have no slope in relation to the length of the log and each of the surfaces angles downward to the outside of the notch in the relation to the radius of the log.

Surface 23 is on a plane that has compound angles with the same upward angle from surface 26 as surface 24 does from surface 27 in relation to the length of the log, and the same downward angle from surface 24 that surface 26 does from surface 27 in relation to the radius of the log.

Surface 25, being on a plane with compound angles, has the same downward angle from surface 24 as surface 28 does from surface 27 in relation to the radius of the log, and the same upward angle from surface 28 as surface 24 does from surface 27 in relation to the length of the log.

Surface 29 is on a plane with compound angles having the same downward angle from surface 30 as surface 26 does from surface 27 in relation to the radius of the log, and the same upward angle from surface 26 as surface 30 from surface 27 in relation to the length of the log.

Surface 31, being on a plane with compound angles, has the same downward angle from surface 30 as surface 28 does from surface 27 in relation to the radius of the log, and the same upward angle from surface 28 as surface 30 does from surface 27 in relation to the length of the log.

FIG. 3AC is the bottom view of the notch on the large end of the log; surface 1 being the natural round front of the log, surface 3 the natural round rear of the log, and surface 4 the flat bottom surface milled into the log.

The width of surfaces 35, 36, 37, and the depth of surfaces 4, 33, 36, and 39 are each equal to distance W. The horizontal width of surfaces 32, 33, 34, 38, 39, and surface 40 are each equal to distance SX, as determined in FIG. 18. The horizontal depth of surfaces 32, 34, 35, 37, 38, and 40 each equal distance LX, as shown in FIG. 17. The entire depth of the notch, distance LW, is shown in FIG. 14. The entire width of the notch, distance SW, is shown in FIG. 13.

Surface 36, the bottom of the center block, is level with zero tilt in relation to the radius and the length of the log. Surfaces 35 and 37, having no tilt in relation to the length of the log, both angle upwards from surface 36, in opposite directions, to the outer edges of the notch in relation to the radius of the log.

Surfaces 33 and 39 are both level and have no tilt in relation to the radius of the log; both angle downward from surface 36 in opposite directions until each surface meets surface 4 at their side of the notch.

Surface 32, being on a plane with compound angles, has the same upward angle from surface 33 as surface 35 does from surface 36 in relation to the radius of the log, and the same downward angle from surface 35 as surface 33 does from surface 36 in relation to length of the log.

Surface 34, being on a plane with compound angles, has the same upward angle from surface 33 as surface 37 does from surface 36 in relation to the radius of the log, and the same downward angle from surface 37 as surface 33 does from surface 36 in relation to the length of the log.

Surface 38, being on a plane that has compound angles, angles upward from surface 39 at the same angle that surface 35 does from surface 36 in relation to the radius of the log, and the same downward angle from surface 35 as surface 39 does from surface 36 in relation to the length of the log.

Surface 40, also being on a plane with compound angles, has the same upward angle from surface 39 as surface 37 does from surface 36 in relation to the radius, and the same downward angle from surface 37 as surface 39 does from surface 36 in relation to the length of the log.

Figure 3B:
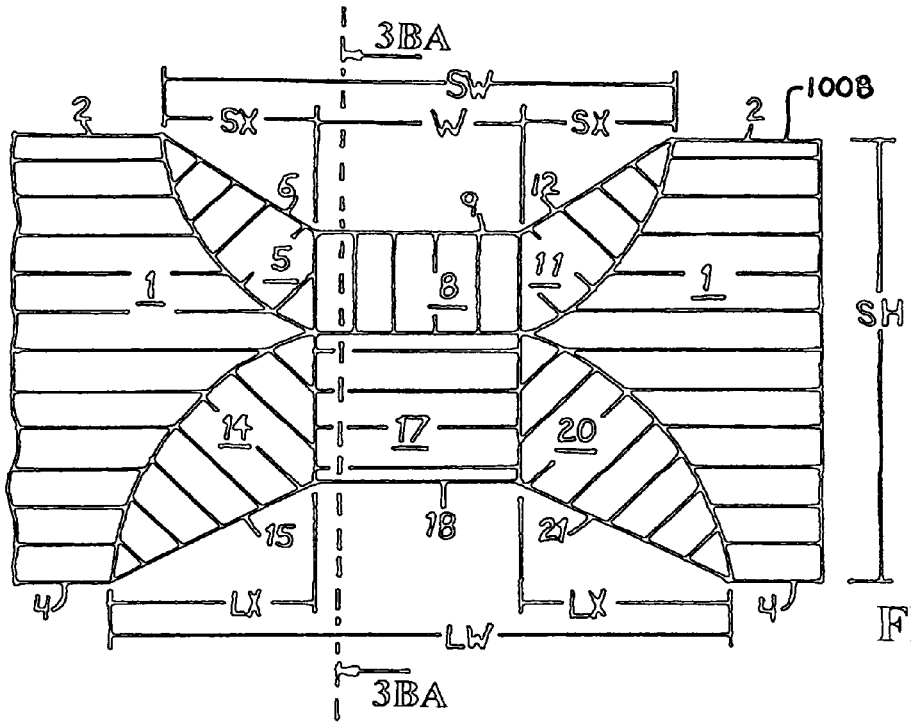
FIG. 3B is a side view of the notch on the small end of the log.
Figure 3B:
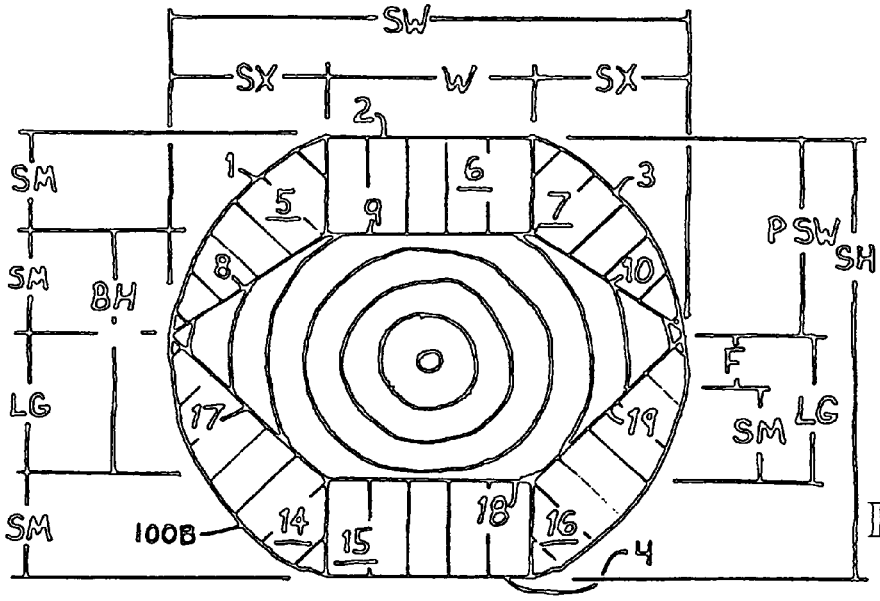
Figure 3B:
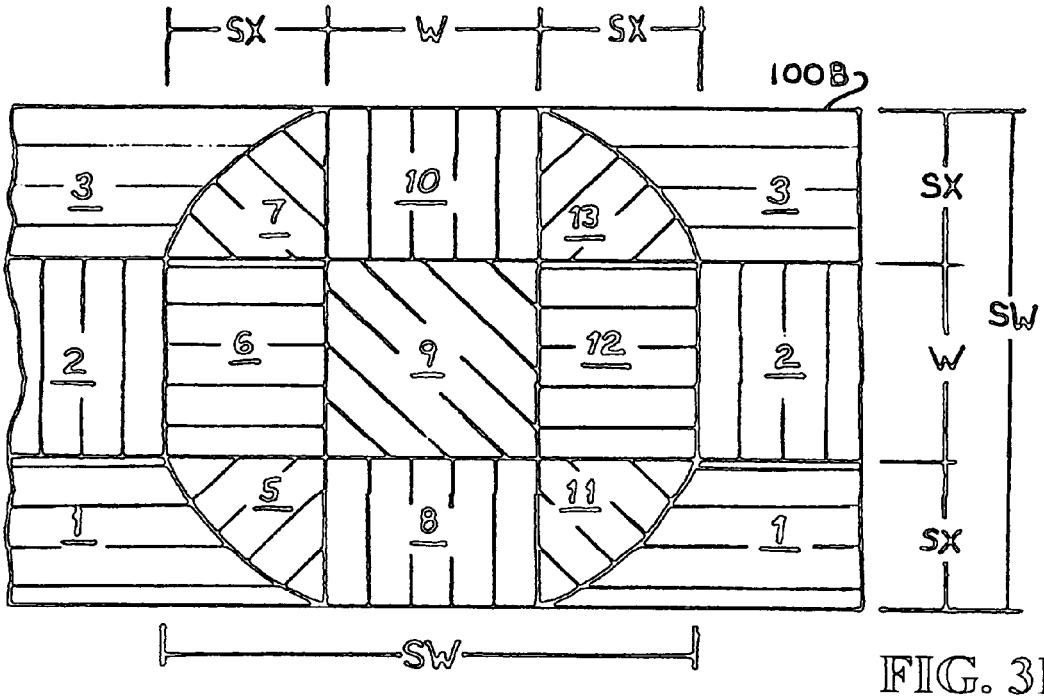
Figure 3B:
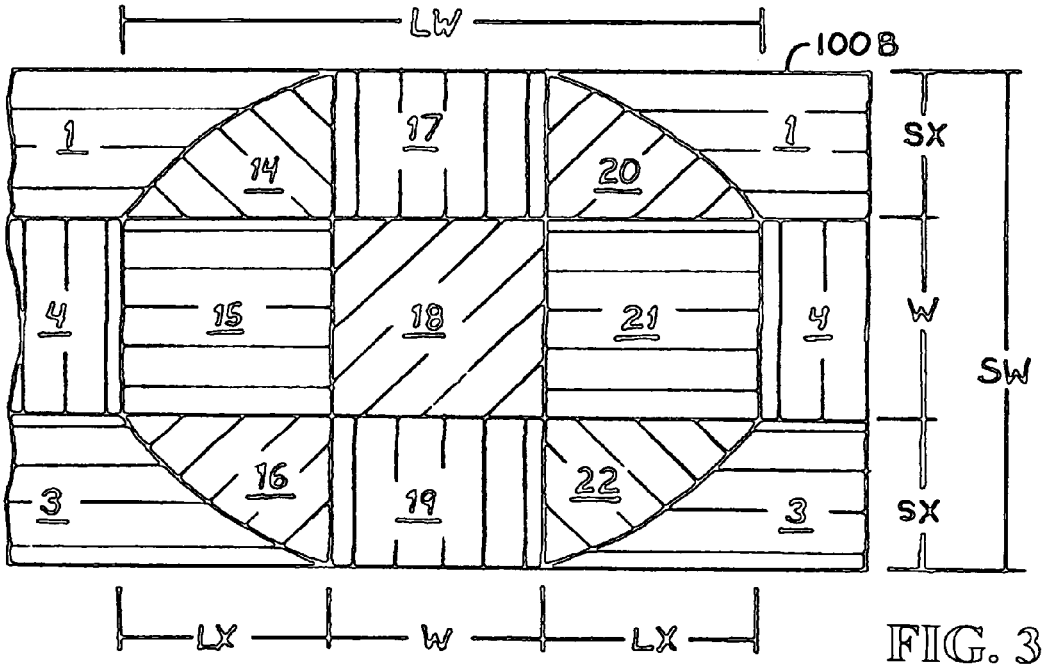

FIG. 3B shows the side view of the notch on the small end of the log; surface 1 being the naturally round front of the log, surface 2 the flat top, and surface 4 the flat bottom surface of the log.

The overall height of the log at the center of the notch is distance SH, as determined in FIG. 5. The overall width of the upper section of the notch, distance SW, is also the sum the horizontal distance SX of where surface 2 meets 6 to where surface 9 meets 6, added to the width of surface 9, distance W, and the horizontal distance of where surface 12 meets 2 to where surface 9 meets surface 12, also being distance SX, as shown in FIG. 18.

Surface 8 angles down from surface 9 to the point where surface 8 meets surface 17 in relation to the radius of the log and has no tilt in relation to the length of the log.

Surface 5, being on a plane with a compound angle, has the same upward angle from surface 8 as surface 6 does from surface 9 in relation to the length of the log and angles downward from surface 6 the same as surface 8 does from surface 9 in relation to the radius of the log.

Surface 11, being on a plane with compound angles, has the same upward angle from surface 8 that surface 12 does from surface 9 in relation to the length of the log and downward from surface 12 the same as surface 8 does from surface 9 in relation to the radius of the log.

The overall width of the lower section of the log, distance LW, equals the sum of the width of surface 18, distance W, and both of the distances LX as found in FIG. 14.

Surface 17 angles upward from surface 18 to the point 17 meets surface 8 in relation to the radius of the log and has no tilt in relation to the length of the log.

Surface 14, being on a plane with compound angles, has the same upward angle from surface 15 as surface 17 does from surface 18 in relation to the radius of the log and downward angle from surface 17 as surface 15 does from surface 18 in relation to the length of the log.

Surface 20 is also on a plane with a compound angle, has the same upward angle from surface 21 as surface 17 does from surface 18 in relation to the radius of the log, and the same downward angle from surface 17 as surface 21 does from surface 18 in relation to the length of the log.

FIG. 3BA is the sectional view of the notch on the small end of the log. The overall depth of the notch, distance SW, is the total sum of the depth of each surface 8 and surface 10 added to the depth of surface 2, distance W, as shown in FIG. 13. The overall height of the log, distance SH, is the total sum of three distances SM and one distance LG, as shown in FIG. 8 and FIG. 9. The distance from surface 9 to surface 18, distance BH, is the total sum of the distance between surface 9 to where surfaces 8 and 17 meet, distance SM, and the distance from surface 18 to where surfaces 17 and 8 meet, distance LG, as is shown in FIG. 10.

Surfaces 8, 9, 10, 17, 18, and 19 all have zero tilt in relation to the length of the log. Distance PSW runs from the top surface 2 of the log to the point that surfaces 10 and 19 meet, as shown in FIG. 16. As shown in FIG. 9, distance LG is the sum of distance SM and distance F.

Surface 1 is the naturally rounded front surface of the log, surface 2 the flat top of the log, and surface 3 the naturally rounded rear surface of the log.

Surface 5 is on a plane with a compound angle, has a downward angle from surface 6 the same as surface 8 does from surface 9 in relation to the radius of the log, and the same upward angle from surface 8 as surface 6 does from surface 9 in relation to the length of the log.

Surface 7 is on a plane with a compound angle, has the same upward angle from surface 10 as surface 6 does from surface 9 in relation to the length of the log, and the same downward angle from surface 6 as surface 10 does from surface 9 in relation to the radius of the log.

Surface 14, being on a plane with a compound angle, has the same upward angle from surface 15 as surface 17 does from surface 18 in relation to the radius of the log, and the same downward angle from surface 17 as surface 15 does from surface 18 in relation to the length of the log.

Surface 16, also being on a plane with a compound angle, has the same downward angle from surface 19 as surface 15 does from surface 18 in relation to the length of the log, and the same upward angle from surface 15 as surface 19 does from surface 18 in relation to the radius of the log.

FIG. 3BB is the top view of the notch on the small end of the log; surface 1 being the naturally round front of the log; surface 2 is the flat top surface of the log; and surface 3 is the naturally round rear surface of the log.

The overall width and horizontal depth of the notch each equals distance SW. The width of surfaces 5, 6, 7, 11, 12, 13, and the depths of surfaces 5, 8, 11, 7, 10, and 13 each equal distance SX, as shown in FIG. 18. The width of surface 8, 9, 10, and the depth of surfaces 2, 6, 9, and 12 each equal distance W. Surfaces 8, 9, and 10 all have zero tilt in relation to the length of the log. Surfaces 2, 6, 9, and 12 each have zero tilt in relation to the radius of the log.

Surfaces 6 and 12 both angle upwards from surface 9 in opposing directions, in relation to the length of the log, until each surface meets with surface 2 at the top of the notch. Surfaces 8 and 10 both angle downward from surface 9 in opposing direction, in relation to the radius of the log, until each surface reaches the outer edge of the notch.

Surface 5, being on a plane with a compound angle (having tilt in both the radius and the length), has the same downward angle from surface 6 as surface 8 does from surface 9 in relation to the radius of the log, and the same upward angle from surface 8 that surface 6 does from surface 9 in relation to the length of the log.

Surface 7, being on a plane that has a compound angle, has the same upward angle from surface 10 that surface 6 does from surface 9 in relation to the length of the log, and the same downward angle from surface 6 that surface 10 has from surface 9 in relation to the radius of the log.

Surface 13, being on a plane with a compound angle, has the same upward angle from surface 10 that surface 12 does from surface 9 in relation to the length of the log and the same downward angle from surface 12 that surface 10 does from surface 9 in relation to the radius of the log.

Surface 11, also being on a plane with a compound angle, has the same upward angle from surface 8 that surface 12 does from surface 9 in relation to the length of the log, and the same downward angle from surface 12 that surface 8 has from surface 9 in relation to the radius of the log.

FIG. 3BC is the bottom view of the notch on the small end of the log. The overall width of the notch shown is distance LW as found in FIG. 14. The overall horizontal depth of the notch is distance SW as shown in FIG. 13. The width of surfaces 17, 18, 19, and the depth of surfaces 4, 15, 18, and 21, each equal distance W. The horizontal width of surfaces 14, 15, 16, 20, 21, and 22 each equal distance LX as found in FIG. 17. The horizontal depth of surfaces 14, 17, 20, 16, 19, and 22 each equal distance SX found in FIG. 18.

Surface 1 is the naturally round front of the log. Surface 3 is the naturally round rear surface of the log. Surface 4 is the flat bottom surface of the log.

Surface 18 is the bottom surface of the center notch and has zero degrees of tilt in relation to the length or radius of the log. Surfaces 17 and 19 both run at an upward angle from surface 18, in relation to the radius of the log, in opposite directions until each of the surfaces reaches the outside edge of the log and both have no tilt in relation to the length of the log. Both surfaces 15 and 21 have no tilt in relation to the radius of the log, and both angle downward from surface 18 in opposite directions until each surface meets surface 4 on their side of the notch.

Surface 14, being on a plane with compound angles, has the same downward angle from surface 17 as surface 15 does from surface 18 in relation to the length of the log, and the same upward angle from surface 15 as surface 17 does from surface 18 in relation to the radius of the log.

Surface 16, being on a plane with a compound angle, has the same upward angle from surface 15 as surface 19 does from surface 18 in relation to the radius of the log, and the same downward angle from surface 19 as surface 15 does from surface 18 in relation to the length of the log.

Surface 20, being on a plane with a compound angle, has the same upward angle from surface 21 as surface 17 does from surface 18 in relation to the radius of the log, and the same downward angle from surface 17 that surface 21 does from surface 18 in relation to the length of the log.

Surface 22, also being on a plane with a compound angle, has the same upward angle from surface 21 that surface 19 does from surface 18 in relation to the radius of the log, and the same downward angle from surface 19 that surface 21 does from surface 18 in relation to the length of the log.

Figure 3C:
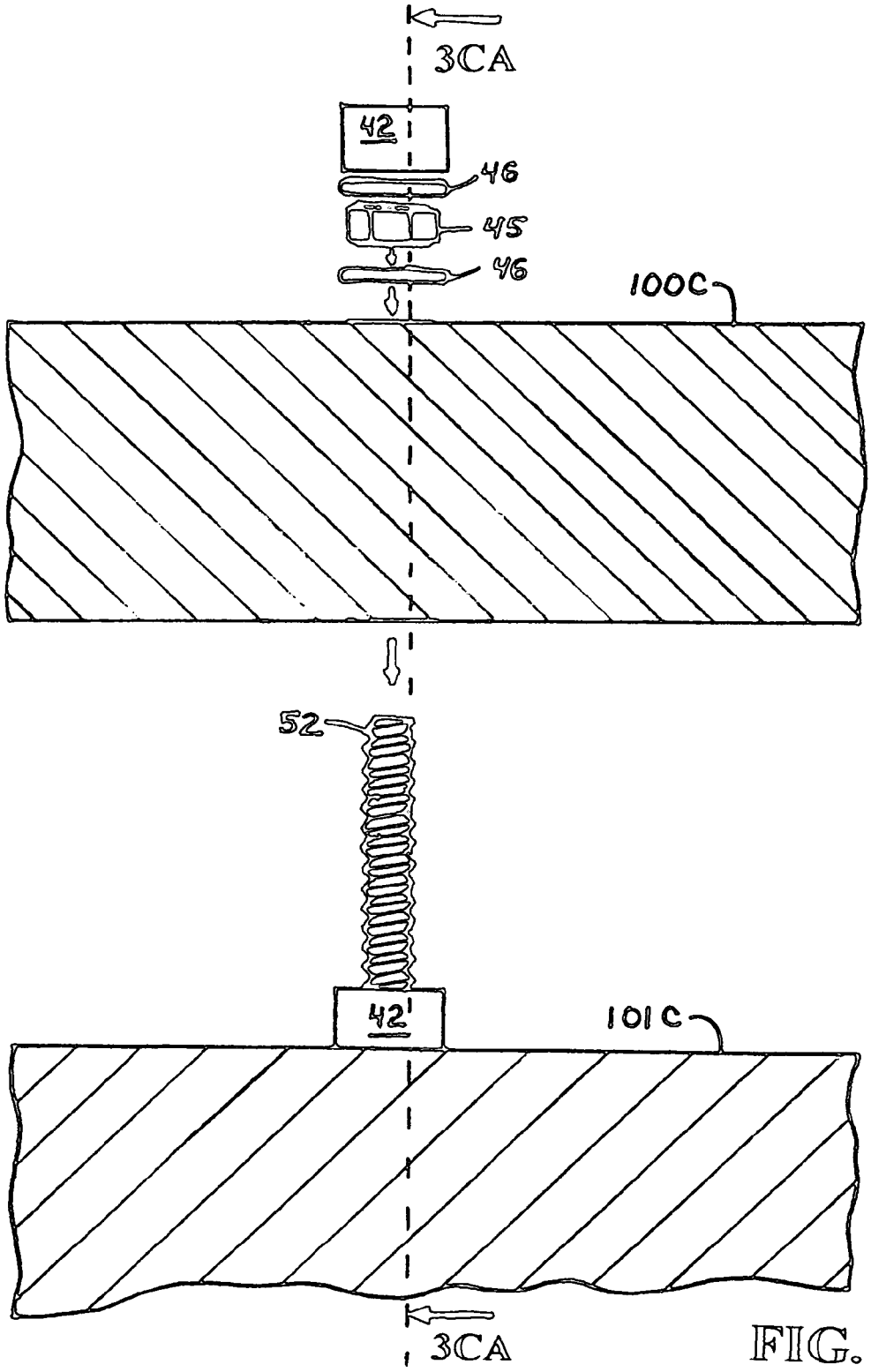
FIG. 3C is a side view of a typical anti-settling thru-bolt with filler block.
Figure 3C:
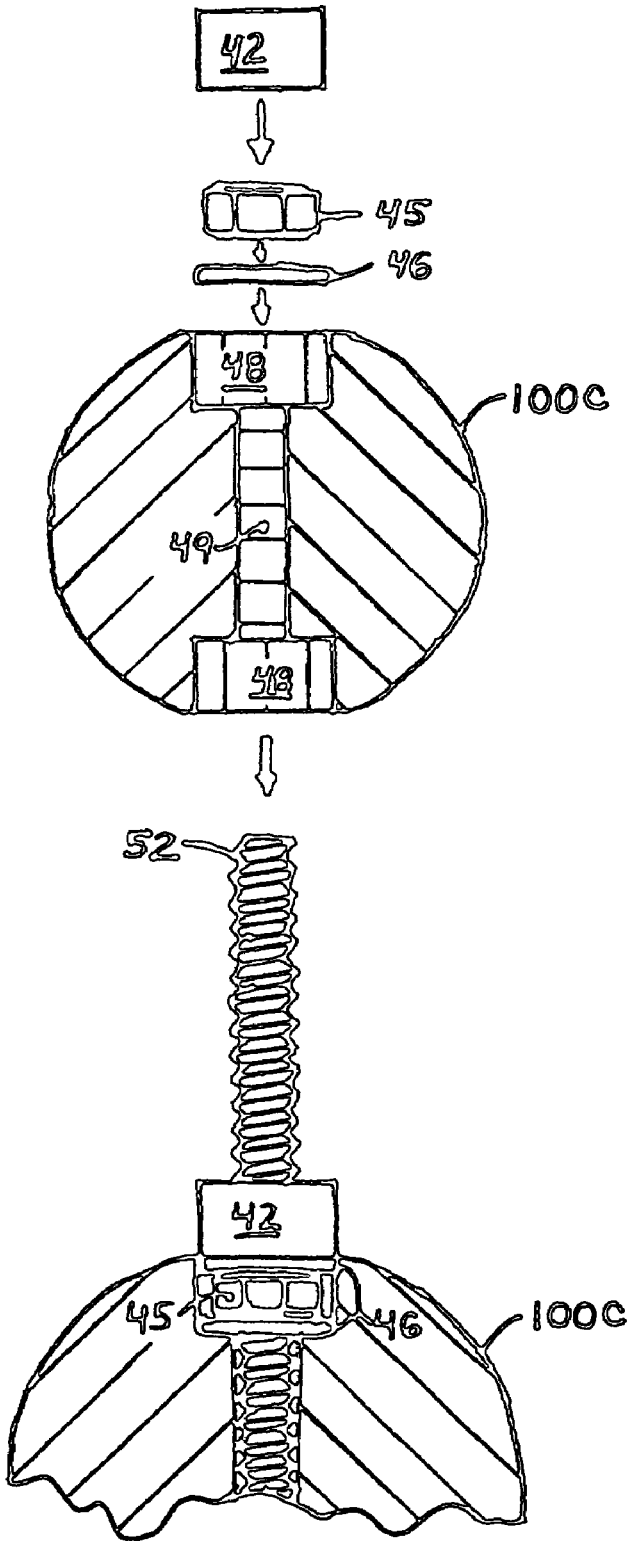

FIG. 3C shows the front view of the log with a standard thru-bolt through the anti-settling blocks. The lower log 100, section 100C shown, with the thru-bolt 52 extending through the log with the tightening hardware already in place. Block 42 is placed down over bolt 52 and the next log 100, section 100C shown, is placed directly on top of the lower log.

Washer 46 is placed over the thru-bolt 52 followed by retaining nut 45 and tightened to secure the log in place. An additional washer 46 and anti-settling block 42 then follows in preparation for the next course of logs.

FIG. 3CA is the sectional view of the standard thru-bolts with the anti-settling blocks. Lower log 100, section 100C shown, already over thru-bolt 52 and secured with retaining nut 45 with washers 46 and anti-settling block 42 in place.

The thru-bolt 52 passes through passage hole 49 and both block recesses 48, these recesses being deep enough to reach the more stable heartwood of the log. The anti-settling blocks are of heartwood or some other material that does not fluctuate with moisture content and are able to structurally support the weight of the building.

The upper log 100, section 100C shown, is then placed onto the lower log with thru-bolt extending through the upper log. Anti-settling block 42 completely fills the recess 48 on the lower section of the upper log and is supported by the upper washer 46 on the lower log.

The anti-settling blocks could be used in places other than at the thru-bolt. To achieve this, recesses 48 are milled into the top of the lower log to the point it reaches the log's heartwood, and the same size recess is milled into the bottom of the lower log to align with the hole on the bottom log. An anti-settling block being modified in height to completely fill both recesses to the point that the block sitting in the recess of the lower log will support the weight of the upper log with the block in the recess of the upper log.

In the event that the heartwood will not support the weight of the upper logs or the depths of the recesses would be too great, additional holes can be bored parallel to passage 49 to reach from recess 48 on the top to recess 48 on the bottom. These holes can then be filled with epoxy resin or something similar that will partially absorb into the wood and then cure to form a solid foundation.

Figure 3D:
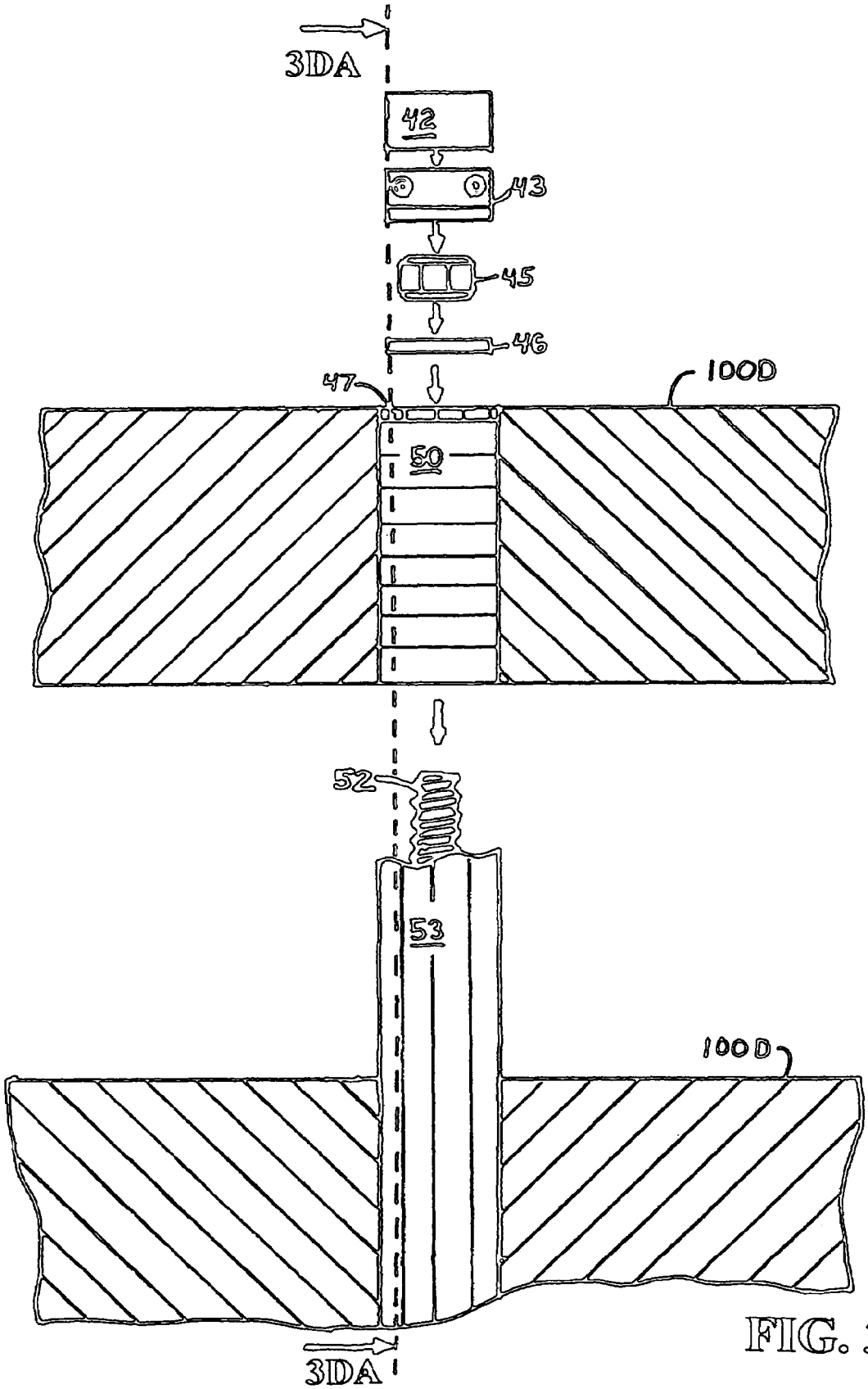
FIG. 3D is the side view of a typical anti-settling thru-bolt and block system with an attachment beam for an interior partition.
Figure 3D:
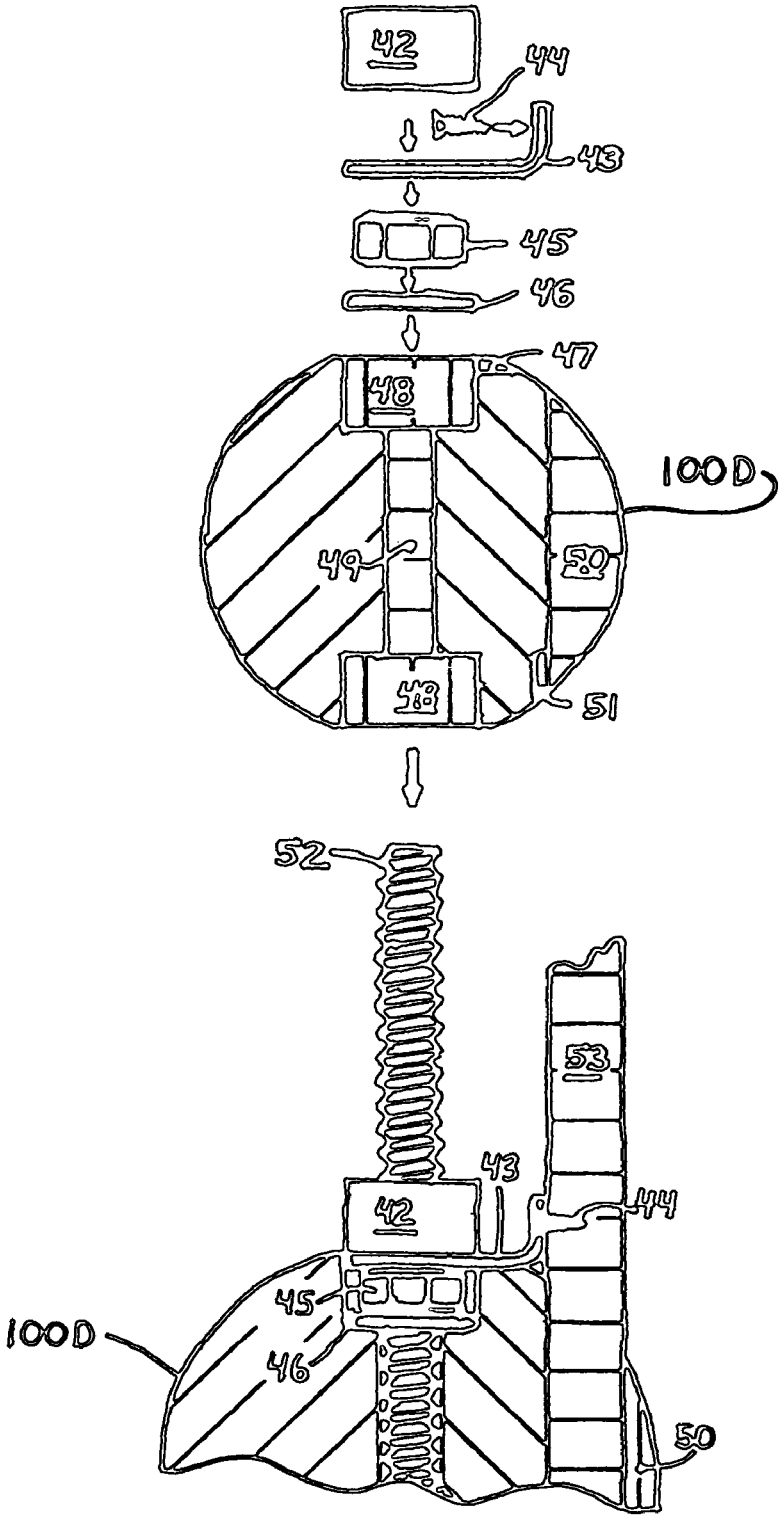
Figure 4A:
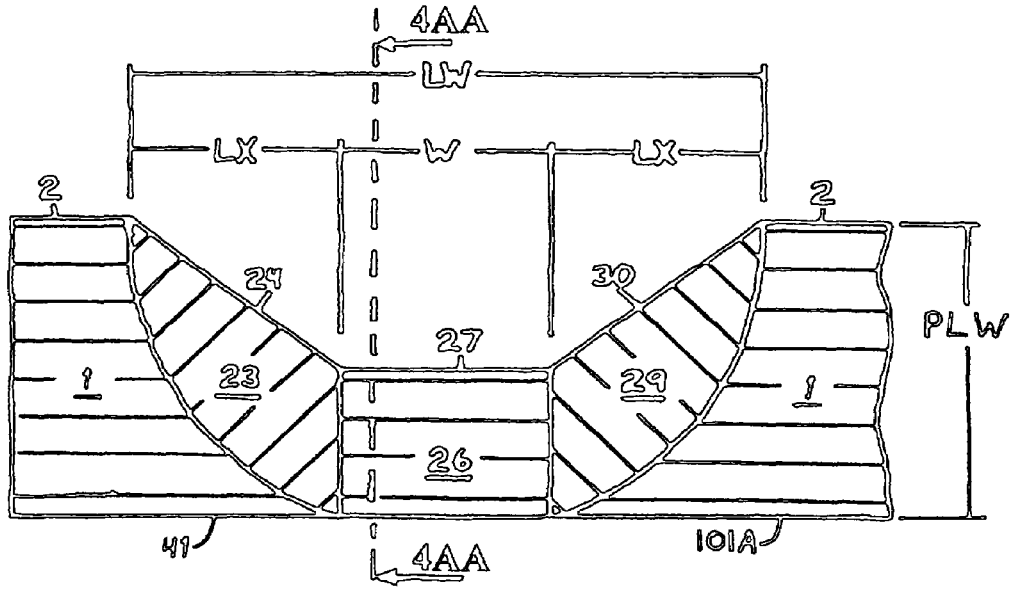
FIG. 4A is the side view of the notch on the large end of the half log.
Figure 4A:
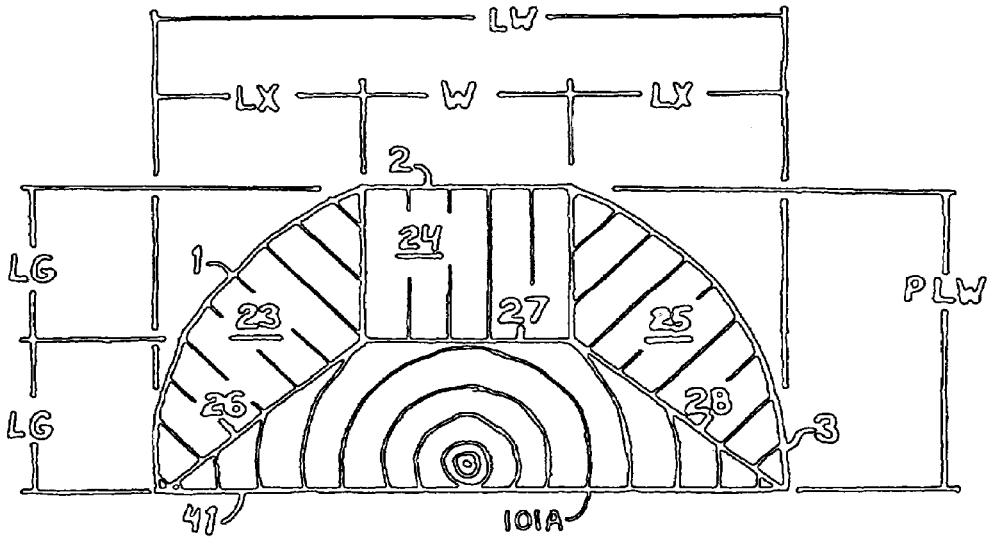
Figure 4B:
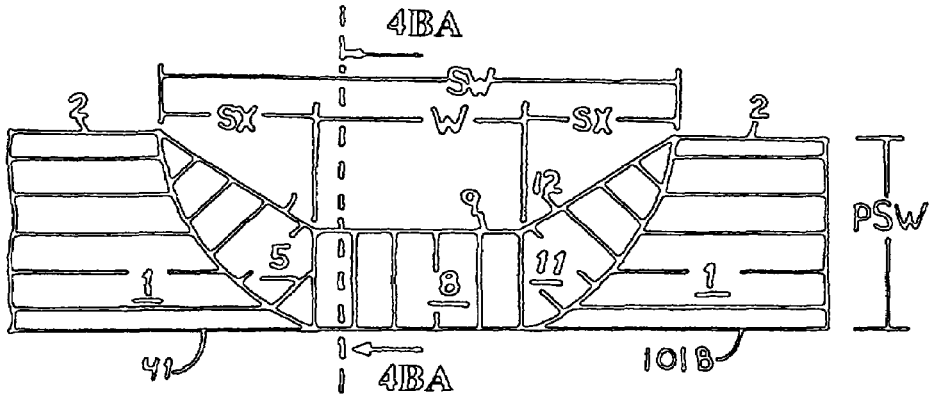
FIG. 4B is the side view of the notch on the small end of the half log.
Figure 4B:
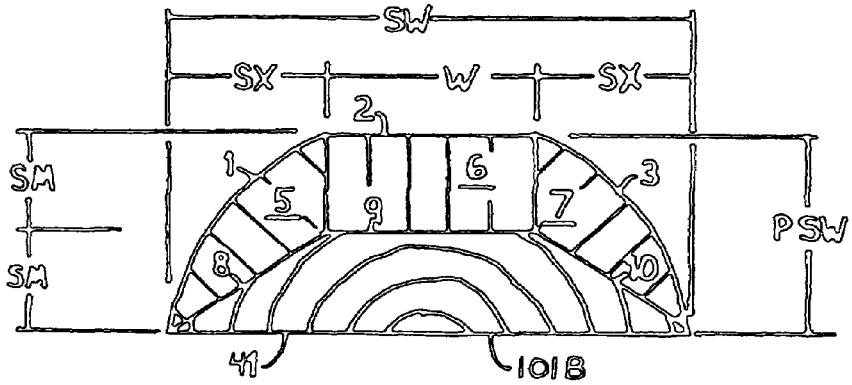

FIG. 3D is the view a thru-bolt with anti-settling blocks and a beam for an interior partition along with the hardware to secure the beam. The purpose of this beam is to eliminate the time-consuming process of carving the slot in the interior wall to accept the standard 2×4 wall construction often used. This also provides a way for the wall to "float," or settle separate from the log shell of the home.

With the lower log 100, shown as section 100D, already secured in place, the upper log 100, also shown as section 100D, is slid over thru-bolt 52 and set directly on the lower log. Wall beam 53 fits tightly into slot 50. Washer 46 and retaining nut 45 is placed onto thru-bolt 52 and is tightened to secure the upper log in place.

The floating beam retaining clip 43 is slid over thru-bolt 52 and sits on top of retaining nut 45 and through slot 47. Screws are then installed threw clip 43 into beam 53.

Spacer block 42 is then slid over thru-bolt 52 and the process is repeated on the next course.

FIG. 3DA is the sectional view of the thru-bolt anchoring system with the anti-settling blocks and the beam for the interior partition.

Lower log 100, shown as log section 100D, is shown in position with washer 46 and retaining nut 45 tightened to secure the log. The floating beam retaining clip has been slid over threaded rod 52 and held in place with screws 44 that have been screwed through the clip and into the floating wall beam 53.

The upper log 100, shown as section 100D, is then slid down onto thru-bolt 52 with the rod passing through hole 49 and the lower recess 48 fitting over anti-settling block 42. Wall beam 53 slips into slot 50.

Washer 46 and retaining nut 45 are then run down the thru-bolt 52 and is tightened to secure the log. The floating beam retaining clip 43 is then placed over thru-bolt 52 and sets on top of nut 45 and in slot 47. Clip 43 is then attached by screws 44 going through clip 43 into beam 53. Anti-settling block 42 is then slid over thru-bolt 52 and sets on top of beam clip 43.

What is claimed is:

1. A beam structure for use in the building of log cabin structures comprising:

a log having a large end and a small end, an upper and lower milled surface, a set of interlocking notches at said small end and a set of interlocking notches at said large end; the set of interlocking notches at said small end comprising a centerblock having eighteen contact surfaces; the set of interlocking notches at said large end comprising a centerblock having eighteen contact surfaces; each said centerblock having a top surface and a bottom surface; each said set of interlocking notches being located at fixed distance from the terminal point of said respective end wherein said fixed distance is equal for the location of both interlocking notches;

whereby each said set of interlocking notches on said beam structure are able to receive and removably interlock with the set of interlocking notches of one or more other beam structures.

2. The beam structure of claim 1 wherein said log has portions defining at least one recess on either the upper milled surface or the lower milled surface, said recess disposed to receive an anti-settling block;

said log further having portions defining one or more holes, said holes being equal in number to said recesses and centered in said recesses and having a uniform diameter that is smaller in size than the total opening of the recess; wherein said holes pass through the entirety of said log along a vertical axis of said log.

3. The beam structure of claim 1, wherein said log has portions defining one or more holes, said holes being uniform in diameter and centered on the width of said log; wherein said holes pass through the entirety of said log.

4. The beam structure of claim 3 further comprising a beam member situated in one or more of said holes and running perpendicular to said beam structure.

5. The beam structure of claim 1 wherein the distance from the bottom of the centerblock along a vertical axis of the beam structure to the plane of the lower milled surface on the large end of the beam structure is equal to the distance from the widest point of the centerblock to the bottom horizontal plane of the centerblock on the small end of said beam structure.

6. The beam structure of claim 1 wherein the distance from widest portion of the centerblock to the horizontal plane of the bottom surface of the centerblock along the y axis of the centerblock on the large end of said beam structure is equal to the distance from the plane extending along said lower milled surface to the bottom of the centerblock on the small end of said beam structure.

7. The beam structure of claim 1 wherein the distance from the bottom of the centerblock along a vertical axis of the beam structure to the plane of the lower milled surface on the large end of the beam structure is equal to the distance from the widest point of the centerblock to the bottom horizontal plane of the centerblock on the small end of said beam structure; and the distance from widest portion of the centerblock to the horizontal plane of the bottom surface of the centerblock along a vertical axis of the centerblock on the large end of said beam structure is equal to the distance from the plane extending along said lower milled surface to the bottom of the centerblock on the small end of said beam structure.

8. A beam element used in the construction of log cabins comprising:

an elongated element being substantially straight in nature and having a first end and a second end;

said elongated element having a first interlocking notch located in proximity to the first end and a second interlocking notch located in proximity to the second end;

each said interlocking notch having a multi-beveled center block disposed to removably connect with other identical beam elements;

said first interlocking notch having a top-side A and a bottom side B;

said second interlocking notch having a top-side C and a bottom side D;

said first interlocking notch and said second interlocking notch being of varying dimensions such that top side A is only able to removably connect with portion A of another identical beam element; bottom side B is only able to removably connect with portion D of another identical beam element; top-side C is only able to removably connect with portion C of another identical beam element; and bottom side D is only able to removably connect with portion B of another identical beam element.

* * * * *